US008818249B2

(12) United States Patent
Kaseda

(10) Patent No.: US 8,818,249 B2
(45) Date of Patent: Aug. 26, 2014

(54) IMAGE FORMING APPARATUS

(75) Inventor: Shinya Kaseda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 341 days.

(21) Appl. No.: 13/239,432

(22) Filed: Sep. 22, 2011

(65) Prior Publication Data

US 2012/0076554 A1 Mar. 29, 2012

(30) Foreign Application Priority Data

Sep. 29, 2010 (JP) ..... 2010-220010

(51) Int. Cl.
*G03G 15/16* (2006.01)
*G03G 15/20* (2006.01)
*G03G 15/00* (2006.01)

(52) U.S. Cl.
CPC ..... *G03G 15/6558* (2013.01); *G03G 15/161* (2013.01); *G03G 15/1615* (2013.01)
USPC ..... 399/316; 399/312

(58) Field of Classification Search
USPC ..... 399/316, 312, 317
See application file for complete search history.

(56) References Cited

U.S. PATENT DOCUMENTS

2004/0156663 A1* 8/2004 Omata et al. ..... 399/400
2010/0142981 A1* 6/2010 Gibson et al. ..... 399/44
2011/0026954 A1* 2/2011 Kishi ..... 399/44

FOREIGN PATENT DOCUMENTS

JP 8-106219 4/1996
JP 2000-172048 6/2000
JP 2007-57715 3/2007
JP 2010-134141 A 6/2010

OTHER PUBLICATIONS

Translated front page of priority document, JP 2012-073537.*
Machine translation of Hideo, JP H 08-106219 (1996).*

* cited by examiner

*Primary Examiner* — David Gray
*Assistant Examiner* — Sevan A Aydin
(74) *Attorney, Agent, or Firm* — Rabin & Berdo, P.C.

(57) ABSTRACT

An image forming apparatus includes a primary transfer body that bears a developer image, a secondary transfer portion for transferring the developer image from the primary transfer body to a medium, and an introduction portion provided on an upstream side of the secondary transfer portion in a conveying direction of the medium. The introduction portion introduces the primary transfer portion and the medium toward the secondary transfer portion. The introduction portion has a gap having a predetermined distance therebetween.

19 Claims, 12 Drawing Sheets

FIG.5

| GAP L (mm) | THICKNESS OF RECORDING MEDIUM t (mm) | | | | | | | |
|---|---|---|---|---|---|---|---|---|
| | 0.1 | 0.2 | 0.3 | 0.4 | 0.5 | 0.6 | 0.7 | 0.8 |
| −0.7 | × | × | × | × | × | × | × | × |
| −0.6 | × | × | × | × | × | × | × | × |
| −0.5 | × | × | × | × | × | × | × | × |
| −0.4 | × | × | × | × | × | × | × | × |
| −0.3 | ○ | △ | × | △ | × | × | × | × |
| −0.2 | ○ | ○ | △ | △ | △ | × | × | × |
| −0.1 | ○ | ○ | ○ | △ | △ | × | × | × |
| 0 | ○ | ○ | ○ | ○ | △ | △ | × | × |
| 0.1 | ○ | ○ | ○ | ○ | ○ | △ | △ | × |
| 0.2 | ○ | ○ | ○ | ○ | ○ | ○ | △ | △ |
| 0.3 | ○ | ○ | ○ | ○ | ○ | ○ | ○ | △ |
| 0.4 | ○ | ○ | ○ | ○ | ○ | ○ | ○ | ○ |
| 0.5 | ○ | ○ | ○ | ○ | ○ | ○ | ○ | ○ |
| 0.6 | ○ | ○ | ○ | ○ | ○ | ○ | ○ | ○ |
| 0.7 | ○ | ○ | ○ | ○ | ○ | ○ | ○ | ○ |
| 0.8 | ○ | ○ | ○ | ○ | ○ | ○ | ○ | ○ |
| 0.9 | ○ | ○ | ○ | ○ | ○ | ○ | ○ | ○ |
| 1.0 | ○ | ○ | ○ | ○ | ○ | ○ | ○ | ○ |
| 1.1 | ○ | ○ | ○ | ○ | ○ | ○ | ○ | ○ |
| 1.2 | ○ | ○ | ○ | ○ | ○ | ○ | ○ | ○ |
| 1.3 | ○ | ○ | ○ | ○ | ○ | ○ | ○ | ○ |
| 1.4 | ○ | ○ | ○ | ○ | ○ | ○ | ○ | ○ |
| 1.5 | ○ | ○ | ○ | ○ | ○ | ○ | ○ | ○ |
| 1.6 | ○ | ○ | ○ | ○ | ○ | ○ | ○ | ○ |
| 1.7 | ○ | ○ | ○ | ○ | ○ | ○ | ○ | ○ |
| 1.8 | ○ | ○ | ○ | ○ | ○ | ○ | ○ | ○ |
| 1.9 | ○ | ○ | ○ | ○ | ○ | ○ | ○ | ○ |
| 2.0 | ○ | ○ | ○ | ○ | ○ | ○ | ○ | ○ |
| 2.1 | ○ | ○ | ○ | ○ | ○ | ○ | ○ | ○ |
| 2.2 | ○ | ○ | ○ | ○ | ○ | ○ | ○ | ○ |
| 2.3 | ○ | ○ | ○ | ○ | ○ | ○ | ○ | ○ |
| 2.4 | ○ | ○ | ○ | ○ | ○ | ○ | ○ | ○ |
| 2.5 | ○ | ○ | ○ | ○ | ○ | ○ | ○ | ○ |
| 2.6 | ○ | ○ | ○ | ○ | ○ | ○ | ○ | ○ |
| 2.7 | ◇ | ○ | ○ | ○ | ○ | ○ | ○ | ○ |
| 2.8 | □ | ◇ | ○ | ○ | ○ | ○ | ○ | ○ |
| 2.9 | □ | □ | ◇ | ○ | ○ | ○ | ○ | ○ |
| 3.0 | □ | □ | ◇ | ◇ | ○ | ○ | ○ | ○ |
| 3.1 | □ | □ | □ | ◇ | ◇ | ○ | ○ | ○ |
| 3.2 | □ | □ | □ | □ | ◇ | ◇ | ○ | ○ |
| 3.3 | □ | □ | □ | □ | □ | ◇ | ◇ | ○ |
| 3.4 | □ | □ | □ | □ | □ | ◇ | ◇ | ◇ |
| 3.5 | □ | □ | □ | □ | □ | □ | ◇ | ◇ |
| 3.6 | □ | □ | □ | □ | □ | □ | □ | ◇ |
| 3.7 | □ | □ | □ | □ | □ | □ | □ | ◇ |
| 3.8 | □ | □ | □ | □ | □ | □ | □ | ◇ |
| 3.9 | □ | □ | □ | □ | □ | □ | □ | □ |

COMPARISON EXAMPLE

COMPARISON EXAMPLE

IMAGE FORMING APPARATUS

BACKGROUND OF THE INVENTION

The present invention relates to an image forming apparatus that forms an image on a medium.

In a conventional image forming apparatus, a toner image is formed by an image forming portion, and is transferred to a belt-shaped intermediate transfer body at a primary transfer portion. Then, at a secondary transfer portion, the intermediate transfer body contacts a recording medium conveyed by a conveying unit, and the toner image is transferred to the recording medium by Coulomb force (see, Patent Document No. 1).

Patent Document No. 1: Japanese Laid-open Patent Publication No. 2010-134141 (paragraphs 0013-0019, FIG. 1)

However, in the conventional image forming apparatus, when the toner image is transferred from the intermediate transfer body to the recording medium at the secondary transfer portion, an electrical discharge may occur between the intermediate transfer body (bearing the toner image) and the recording medium. Such an electrical discharge may cause transfer scattering (i.e., scattering of toner), and therefore image defects may occur.

SUMMARY OF THE INVENTION

In an aspect of the present invention, it is intended to provide an image forming apparatus capable of preventing image defects caused by transfer scattering or the like.

According to an aspect of the present invention, there is provided an image forming apparatus including a primary transfer body that bears a developer image, a secondary transfer portion for transferring the developer image from the primary transfer body to a medium, and an introduction portion provided on an upstream side of the secondary transfer portion in a conveying direction of the medium. The introduction portion introduces the primary transfer portion and the medium toward the secondary transfer portion. The introduction portion has a gap having a predetermined distance therebetween.

With such a configuration, it becomes possible to prevent image defects caused by transfer scattering or the like.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the attached drawings:

FIG. 5 is a table showing experimental results of printing test;

DETAILED DESCRIPTION OF THE PREFERRED EMBODIMENT

Hereinafter, embodiments of the present invention will be described with reference to drawings.

First Embodiment

Figure 1:
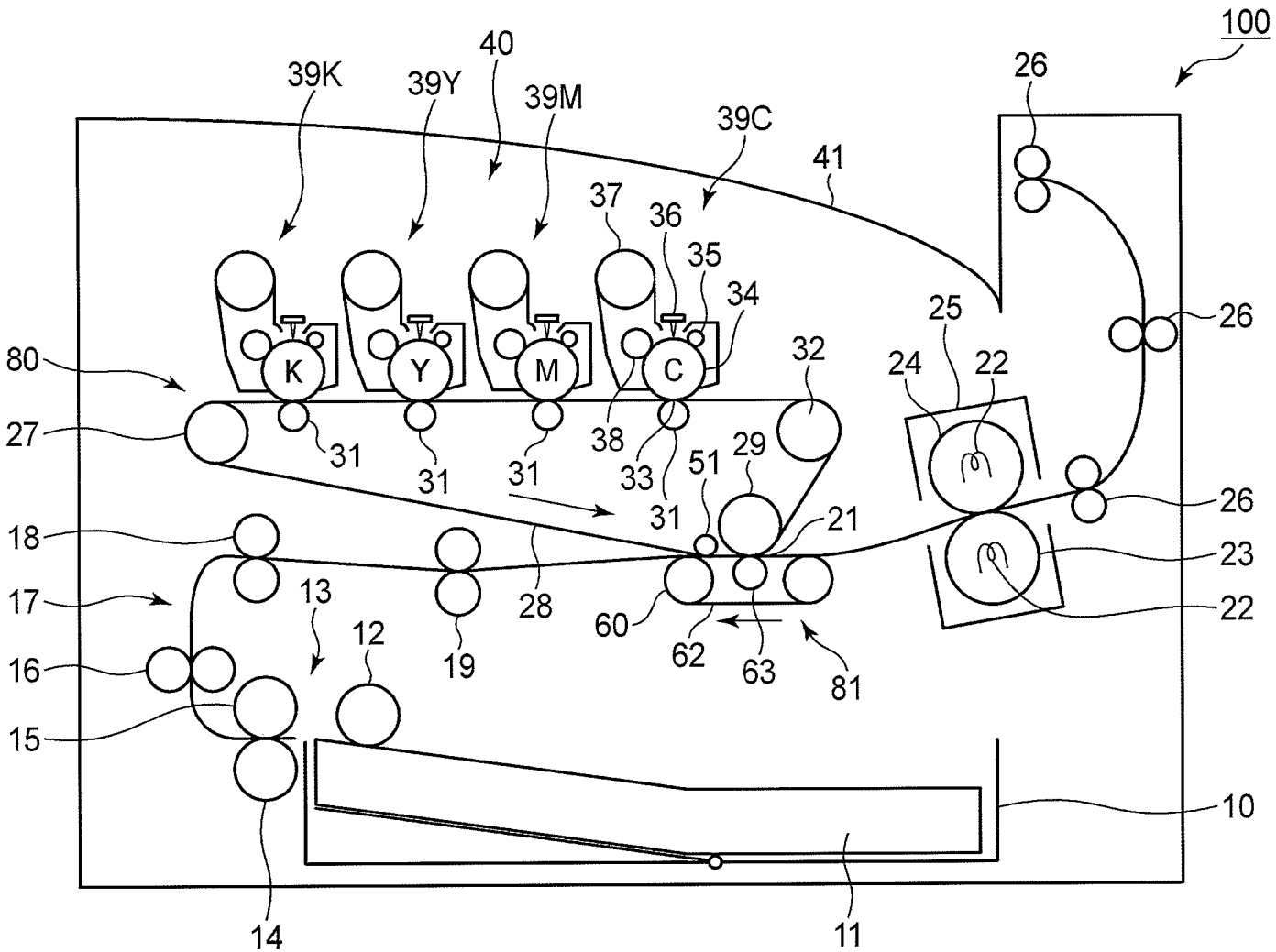
FIG. 1 is a schematic side view showing a configuration of an image forming apparatus according to the first embodiment of the present invention.

FIG. 1 is a schematic side view showing a configuration of an image forming apparatus 100 according to the first embodiment of the present invention.

The image forming apparatus 100 is configured as, for example, an electrophotographic printer. The image forming apparatus 100 includes a medium tray 10 in which recording media (i.e., media) 11 such as printing sheets are stored. A medium feeding portion 13 is provided on a feeding side (i.e., left side in FIG. 1) of the medium tray 10. The medium feeding portion 13 is configured to feed the recording medium 11 one by one out of the medium tray 10. The medium feeding portion 13 includes a pickup roller 12 that contacts the topmost recording medium 11 lifted to a predetermined height. The medium feeding portion 13 further includes a feeding roller 15 and a retard roller 14 for separately feeding the recording medium 11 picked up by the pickup roller 12.

A medium conveying portion 17 is provided on a downstream side of the medium feeding portion 13 in a conveying direction of the recording medium 11. The medium conveying portion 17 includes a plurality of conveying roller pairs 16, 18 and 19 for conveying the recording medium 11 toward a secondary transfer portion 21 described later.

An image forming portion 40 includes four toner image forming units 39 (39C, 39M, 39Y and 39K) as developer image forming units for forming toner images (i.e., developer images) of cyan, magenta, yellow and black. The image forming portion 40 further includes four primary transfer portions 33 for transferring the toner images from the toner image forming units 39 to an intermediate transfer belt 28 as a primary transfer body using Coulomb force.

Each toner image forming unit 39 includes an OPC (Organic Photoconductor) drum 34 as an image bearing body that bears a toner image, a charging roller 35 as a charging member that negatively charges the surface of the OPC drum 34, and a printing head 36 as an exposure unit that exposes the surface of the OPC drum 34 to form a latent image thereon. The printing head 36 is constituted by, for example, an LED (Light Emitting Diode) array. Each toner image forming unit 39 further includes a developing roller 38 as a developing member that develops the latent image on the surface of the OPC drum 34 to form a toner image, and a toner supply portion 37 as a developer supply portion that supplies the toner to the developing roller 38.

A transfer belt unit 80 is provided below the image forming portion 40. The transfer belt unit 80 includes primary transfer rollers 31, a driving roller 27, a pre-transfer introduction roller 51 as an introduction roller, a backup roller 29, a tension roller 32 and the intermediate transfer belt 28.

The transfer belt unit 80 is also referred to as a developer image bearing unit of the image forming unit 100. The transfer belt unit 80 is configured so that the toner image is transferred to the intermediate transfer belt 28 at the primary transfer portion 33, and the intermediate transfer belt 28 carries the toner image to the secondary transfer portion 21. At the secondary transfer portion 21, the toner image on the intermediate transfer belt 28 is transferred to the recording medium 11 (conveyed by a conveying belt unit 81) by Coulomb force. Detailed description of the transfer belt unit 80 and the conveying belt unit 81 will made later.

A fixing portion 25 is provided on the downstream side of the secondary transfer portion 21. The fixing portion 16 is configured to fix the toner image (transferred to the recording medium 11 at the secondary transfer portions 21) to the recording medium 11 by applying heat and pressure. The fixing portion 25 includes an upper roller 24 and a lower roller 23 both of which have halogen lamps 22 as internal heat sources and surface layers made of resilient bodies.

Ejection rollers 26 are provided on the downstream side of the fixing portion 25. The ejection rollers 26 eject the recording medium 11 to the outside of the image forming apparatus 100. A stacker portion 14 is provided on an upper part of the image forming apparatus 100 on which the ejected recording medium 11 is placed.

Next, description will be made of a transfer portion including the transfer belt unit 80 and the conveying belt unit 81.

Figure 2:
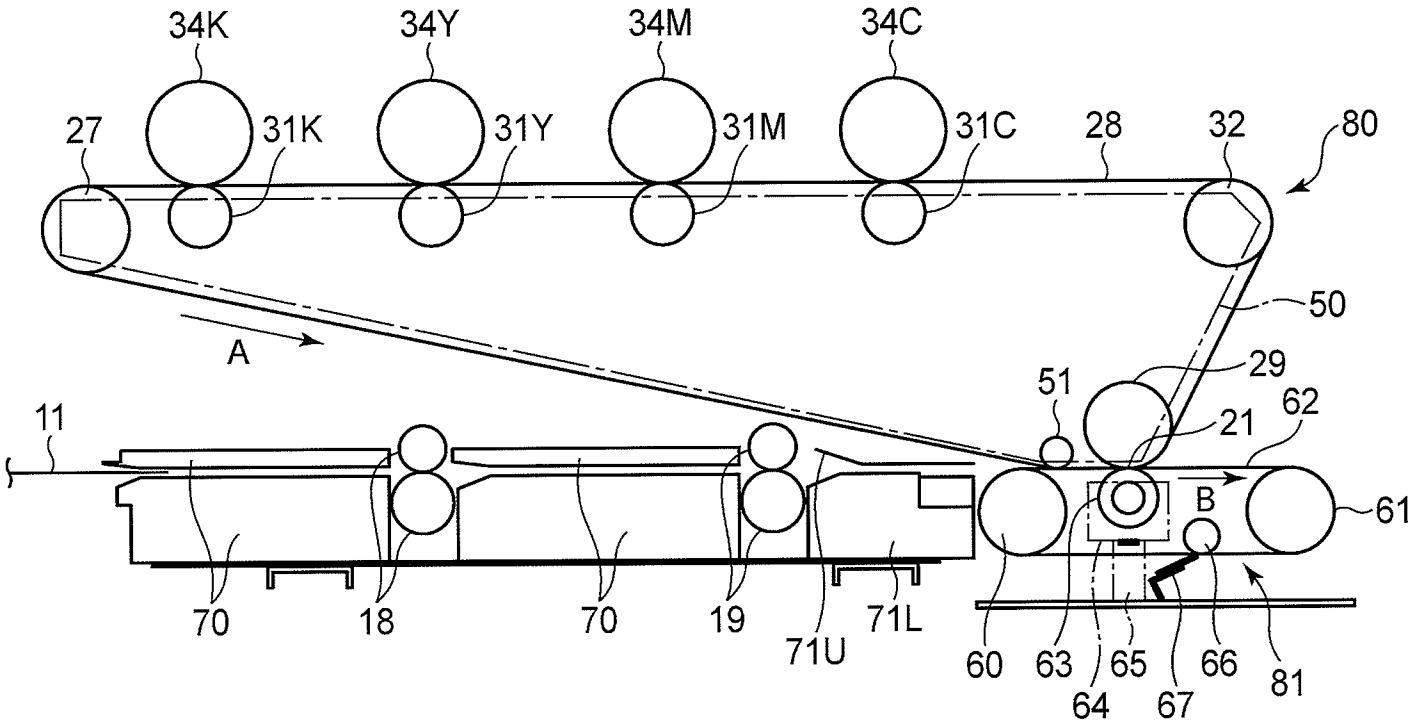
FIG. 2 is a schematic side view showing a transfer portion of the image forming apparatus according to the first embodiment.

FIG. 2 is a schematic side view showing the transfer portion (i.e., the transfer belt unit 80 and the conveying belt unit 81) according to the first embodiment.

In FIG. 2, the transfer belt unit 80 includes four primary transfer rollers 31 (31C, 31M, 31Y and 31K), the driving roller 27, the pre-transfer introduction roller 51, the backup roller 29 and the tension roller 32. These rollers are supported by a belt frame 50 via not shown bearings, and are rotatable in counterclockwise directions in FIG. 2. The intermediate transfer belt 28 as the primary transfer body is stretched around the primary transfer rollers 31, the driving roller 27, the pre-transfer introduction roller 51, the backup roller 29 and the tension roller 32.

The driving roller 27 supports the intermediate transfer belt 28 in a stretched manner, and rotates the intermediate transfer belt 28. The driving roller 27 is rotated by a not shown motor and gears, and causes the intermediate transfer belt 28 to rotate in a counterclockwise direction as shown by an arrow A.

The intermediate transfer belt 28 is in the form of an endless belt (i.e., a belt member) and is composed of, for example, a semiconductive plastic film having high resistance made from polyimide (PI). In this embodiment, the intermediate transfer belt 28 has a thickness of 80 μm, and a surface resistivity of $10^9\Omega/\square$.

The pre-transfer introduction roller 51 is provided on the downstream side of the driving roller 27 in the conveying direction A of the intermediate transfer belt 28. The pre-transfer introduction roller 51 is formed of a metal roller as described later. The backup roller 29 is provided on the downstream side of the pre-transfer introduction roller 51 in the conveying direction A of the intermediate transfer belt 28. The backup roller 29 is formed of a metal roller as described later.

The pre-transfer introduction roller 51 as a stretching member supports the intermediate transfer belt 28 in a stretched manner. The pre-transfer introduction roller 51 is provided on an upstream side of the secondary transfer portion 21 in the conveying direction of the intermediate transfer belt 28. The pre-transfer introduction roller 51 is a roller member composed of, for example, stainless steel (SUS) and has a radius R1 of, for example, 7 mm. In this regard, the pre-transfer introduction roller 51 can also be made of other metal than stainless steel (SUS).

The backup roller 29 is composed of, for example, aluminum and has a radius R2 of, for example, 13 mm. In this regard, the backup roller 29 can be made of other metal than aluminum.

The tension roller 32 is provided on the downstream side of the backup roller 29 in the conveying direction A of the intermediate transfer belt 28. The tension roller 32 is pressed at both ends thereof by springs and holders, and applies a tension to the intermediate transfer belt 28. In this embodiment, the tension generated at the intermediate transfer belt 28 is 36 N.

The conveying belt unit 81 is provided below the transfer belt unit 80. The conveying belt unit 81 includes a secondary transfer roller 63 provided so as to face the backup roller 29 via the intermediate transfer belt 28. The conveying belt unit 81 further includes a conveying belt driving roller 60, a cleaning backup roller 66 and a conveying belt tension roller 61 arranged in a counterclockwise direction shown by an arrow B in FIG. 2. A conveying belt 62 as a conveying portion is stretched around the secondary transfer roller 63, the cleaning backup roller 66 and the conveying belt tension roller 61. The cleaning backup roller 66 is pressed against a cleaning blade 67 via the conveying belt 62.

The conveying belt driving roller 60 includes a metal core of aluminum whose outer surface is coated with ceramic. The conveying belt driving roller 60 supports the conveying belt 62 in a stretched manner, and rotates the conveying belt 62. The conveying belt driving roller 60 is rotated by a not shown driving motor and gears, and causes the conveying belt 62 to rotate in a clockwise direction shown by the arrow B so as to convey the recording medium 11 toward the secondary transfer portion 21.

The conveying belt 62 is a belt member composed of, for example, a semiconductive plastic film having high resistance made from polyimide (PI). In this embodiment, the intermediate conveying belt 62 has a thickness of 80 μm, and a surface resistivity of $10^8 \Omega/\square$.

The secondary transfer roller 63 is provided so as to face the backup roller 29 via the intermediate transfer belt 28 and the conveying belt 62. The secondary transfer roller 63 and the backup roller 29 are pressed against each other so as to form a contact region (a nip potion) corresponding to the secondary transfer portion 21. The intermediate transfer belt 28 and the conveying belt 62 are nipped between the secondary transfer roller 63 and the backup roller 29.

The secondary transfer roller 63 has a shaft portion composed of stainless steel (SUS) covered with a urethane rubber layer having electrical conductivity. Both ends of the shaft portion of the secondary transfer roller 63 are exposed, and remaining parts are covered with the urethane rubber layer. The both ends (i.e., exposed ends) of the shaft portion of the secondary transfer roller 63 contact holder members 64. A diameter of both ends of the secondary transfer roller 63 is smaller than the remaining parts of the secondary transfer roller 63 covered with the urethane rubber layer. A difference between the diameters corresponds to a thickness of the urethane rubber layer. In this embodiment, the urethane rubber layer has a volume resistivity of $10^6$ Ωcm.

In this regard, the shaft portion of the secondary transfer roller 63 can be made of metal having electrical conductivity. The urethane rubber layer can be composed of rubber material in which carbon, pigment or the like is dispersed so as to impart electrical conductivity. The urethane rubber can also be replaced with other material having a volume resistivity of $10^2$ to $10^{12}$ Ωcm.

The shaft portion of the secondary transfer roller is connected to a high voltage power source of the image forming apparatus 10 via a not shown contact, and is applied with approximately 0.5 to 3.0 KV for transferring toner image. The holder members 64 are pressed by springs 65 so that the secondary transfer roller 63 (supported by the holder members 64) is pressed toward a center of the backup roller 29. In this embodiment, a force of each spring 65 is 30N. That is, the secondary transfer roller 63 is pressed against the backup roller 29 with the force of 60 N in total.

The conveying belt tension roller 61 is provided on the downstream side of the secondary transfer roller 63 in the conveying direction B of the conveying belt 62. The conveying belt tension roller 61 is composed of resin such as POM (Polyacetal). The conveying belt tension roller 61 is pressed at both ends by not shown springs and holders, and applies a tension to the conveying belt 62. In this embodiment, the tension generated at the conveying belt 62 is 30N.

The cleaning blade 67 as a belt cleaning unit is provided on the downstream side of the conveying belt tension roller 61 in the conveying direction B of the conveying belt 62. The cleaning blade 67 contacts the outer surface of the conveying belt 62. The cleaning backup roller 66 is provided so as to face the cleaning blade 67 via the conveying belt 62.

Conveyance guides 70 are provided for guiding the recording medium 11 through the conveying roller pairs 18 and 19.

Entry guides 71U and 71L as guide members are provided on the upstream side of the pre-transfer introduction roller 51 in the conveying direction of the recording medium 11. As the recording medium 11 conveyed by the conveying roller pairs 18 and 19 of the medium conveying portion 17 (FIG. 1) reaches the entry guides 71U and 71L, the entry guides 71U and 71L guide upper and lower surfaces of the recording medium 11, so that the recording medium 11 is conveyed to the secondary transfer portion 21.

As described above, the transfer portion includes the transfer belt unit 80 and the conveying belt unit 81. The recording medium 11 conveyed by the conveying roller pairs 18 and 19 is guided by the entry guides 71U and 71L, and is conveyed by the conveying belt 62 of the conveying belt unit 81 (as shown by the arrow B) to the secondary transfer portion 21. The pre-transfer introduction roller of the transfer belt unit 80 is located on the downstream side of the entry guides 71U and 71L in the conveying direction of the recording medium 11. The pre-transfer introduction roller 51 supports the intermediate transfer belt 28 so as to leave a predetermined gap between the intermediate transfer belt 28 and the conveying belt 62. The backup roller 29 and the secondary transfer roller 63 are located on the downstream side of the pre-transfer introduction roller 51 in the conveying direction of the recording medium 11. The backup roller 29 and the secondary transfer roller 63 form the secondary transfer portion 21 via the intermediate transfer belt 28 and the conveying belt 62.

The pre-transfer introduction roller 51 is located on the downstream side of the conveying belt driving roller 60 in the conveying direction of the recording medium 11 (hereinafter, referred to as a medium conveying direction). Further, the pre-transfer introduction roller 51 is located so as to face the conveying belt driving roller 60 via the conveying belt 62 and the intermediate transfer belt 28.

Figure 3:
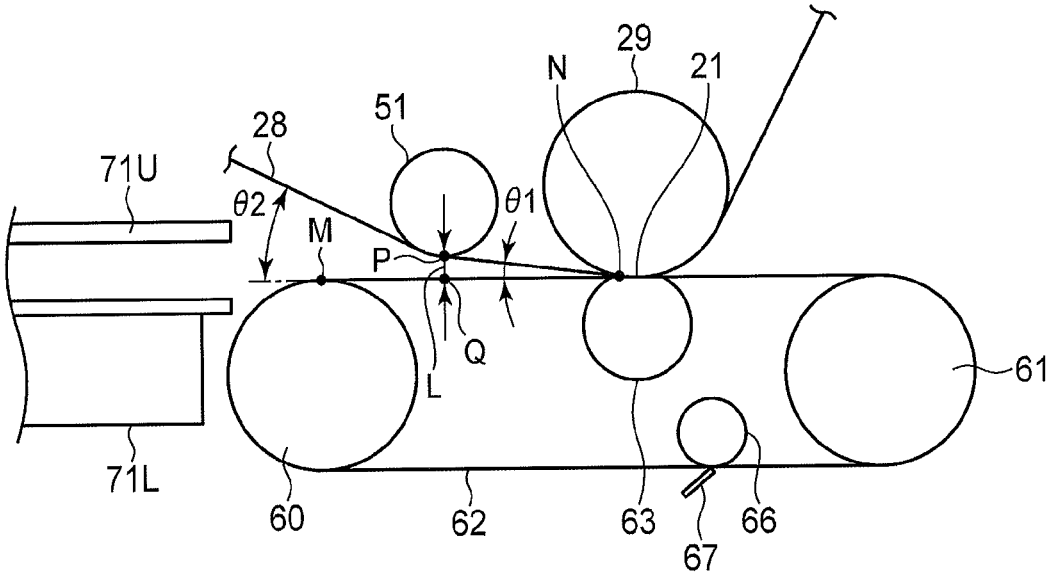
FIG. 3 is a schematic side view showing a configuration around a secondary transfer portion according to the first embodiment of the present invention.

FIG. 3 is a schematic side view showing a configuration around the secondary transfer portion 21 according to the first embodiment.

As shown in FIG. 3, a mark "P" indicates a point where a line extended vertically from a center of the pre-transfer introduction roller 51 intersects with the intermediate transfer belt 28. Further, the point P is defined on a surface side of the intermediate transfer belt 28 facing the recording medium 11. The point P is referred to as a first pre-transfer introduction portion (i.e., a first introduction portion). In other words, the first pre-transfer introduction portion (P) is provided on a portion (i.e., a stretched portion) where the intermediate transfer belt 28 is stretched around the pre-transfer introduction roller 51. Further, the stretched portion is defined on a surface side of the intermediate transfer belt 28 facing away from the pre-transfer introduction roller 51.

An end point N indicates an upstream end (in the medium conveying direction) of the nip portion of the secondary transfer roller 63 and the backup roller 29. An end point M indicates a downstream end (in the medium conveying direction) of a contact portion where the conveying belt driving roller 60 contacts the conveying belt 62.

A mark "Q" indicates a point where a line connecting the end points M and N intersects with the line extended vertically from a center of the pre-transfer introduction roller 51. Further, the point Q is defined on a surface side of the conveying belt 62 facing the recording medium 11. The point Q is referred to as a second pre-transfer introduction portion (i.e., a second introduction portion).

The above described first pre-transfer introduction portion P and the second pre-transfer introduction portion Q constitute a pre-transfer introduction portion (i.e., an introduction portion). The pre-transfer introduction portion is located on the upstream side of the secondary transfer portion 21 in the medium conveying direction.

A gap distance L (mm) between the first pre-transfer introduction portion P and the second pre-transfer introduction portion Q is set to 0.1 mm in this embodiment.

Further, in this embodiment, a minimum thickness $t_{min}$ of the recording medium 11 is 0.1 mm ($t_{min}$=0.1 mm), and a maximum thickness $t_{max}$ of the recording medium 11 is 0.8 mm ($t_{max}$=0.8 mm).

Figure 4:
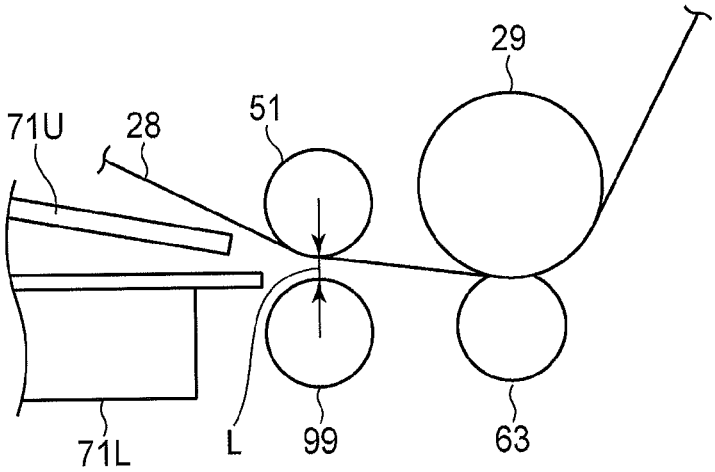
FIG. 4 is a schematic side view showing a modification of a pre-transfer introduction portion of the first embodiment of the present invention.

In this regard, although the second pre-transfer introduction portion (Q) is defined by the conveying belt 62 in this embodiment, the second pre-transfer introduction portion (Q) can also be defined by, for example, a sponge roller 99 as shown in FIG. 4. It is preferable that a line pressure applied to the recording medium 11 entering into the pre-transfer introduction portion (P, Q) is less than or equal to approximately 0.005 N/mm.

An entire operation of the image forming apparatus 100 will be described with reference to FIGS. 1 and 2.

As shown in FIG. 1, the medium tray 10 storing the recording media 11 is detachably mounted to the image forming apparatus 100. The pickup roller 12 is rotated by a not shown driving motor, and picks up the recording medium 11 in the medium tray 10. Further, the feeding roller 15 and the retard roller 14 feed the recording medium 11 one by one. In other words, the recording medium 11 is fed from the medium feeding portion 13.

The recording medium 11 fed from the medium feeding portion 13 reaches the medium conveying portion 17, and is conveyed by the conveying roller pairs 16, 18 and 19 to the secondary transfer portion 21.

In each of the toner image forming unit 39 of the image forming portion 40, the charging roller 35 uniformly charges the surface of the OPC drum 34 to a negative potential, and the printing head 36 (i.e., the LED array) emits light to expose the surface of the OPC drum 34 to form a latent image. The latent image on the surface of the OPC drum 34 is developed by the developing roller 38 using the toner supplied by the toner supply portion 37, so that the toner image is formed on the OPC drum 34.

The toner images formed on the OPC drums 34 of the respective toner image forming units 39 are transferred to the intermediate transfer belt 28 (driven by the driving roller 27) at the primary transfer portions 31 between the OPC drums 34 and the primary transfer rollers 31, so that the charged toner image is formed on the intermediate transfer belt 28. In this regard, the OPC drums 34 of the respective toner image forming portions 39 and the intermediate transfer belt 28 are driven in synchronization with each other, so as to transfer the toner images of the respective colors to the intermediate transfer belt 28 in an overlapping manner.

The toner image (transferred to the intermediate transfer belt 28) is carried to the secondary transfer portion 21, and is transferred to the recording medium 11 by an electric field between the secondary transfer roller and the backup roller 29. The secondary transfer roller 63 is applied with a voltage by a not shown power source. The backup roller 29 is connected to a frame ground (i.e., grounded).

The recording medium 11 to which the toner image is transferred at the secondary transfer portion 21 is conveyed to the fixing portion 25. The fixing portion 25 applies heat and pressure to the recording medium 11 with the toner image so as to melt and fix the toner image to the recording medium 11.

The recording medium 11 to which the toner image is fixed is ejected outside the image forming apparatus 100 by the ejection rollers 26. The ejected recording medium 11 is placed on the stacker portion 41.

An operation of the transfer portion will be described with reference to FIGS. 2 and 3.

First, description will be made of an operation of the transfer portion in the case where the recording medium 11 has the thickness $t_{min}$ (i.e., minimum thickness) of 0.1 mm. As shown in FIGS. 2 and 3, the recording medium 11 is conveyed by the conveying roller pair 19 while the recording medium 11 is guided by the entry guides 71U and 71L, and is brought into contact with the conveying belt 62 of the conveying belt unit 81. Since the thickness of the recording medium is 0.1 mm and the gap distance L (FIG. 3) of the pre-transfer introduction portion (P, Q) is 0.7 mm, the recording medium 11 is not nipped between the conveying belt 62 and the intermediate transfer belt 28 at the pre-transfer introduction portion (P, Q).

Then, the recording medium 11 is further conveyed, and a leading end of the recording medium 11 reaches the secondary transfer portion 21. In this state, the recording medium 11 is nipped between the conveying belt 62 and the intermediate transfer belt 28 at the upstream side of the secondary transfer portion 21. In other words, when the toner image on the recording medium 11 reaches the vicinity of an electric field region between the conveying belt 62 and the backup roller 29, the recording medium 11 is nipped between the conveying belt 62 and the intermediate transfer belt 28. Accordingly, transfer of the toner image to the recording medium 11 does not occur in a state where a gap is formed between the recording medium 11 and the intermediate transfer belt (i.e., before the toner image on the intermediate transfer belt 28 reaches the secondary transfer portion 21). Thus, it becomes possible to prevent occurrence of transfer scattering and resulting image defects immediately before the toner image reaches the secondary transfer portion 21.

Then, the toner image is transferred from the intermediate transfer belt 28 to the recording medium 11 at the secondary transfer portion 21, and is conveyed to the fixing portion 25 shown in FIG. 1.

Next, description will be made of an operation of the transfer portion in the case where the recording medium 11 has the thickness $t_{max}$ (i.e., maximum thickness) of 0.8 mm. As shown in FIGS. 2 and 3, the recording medium 11 is conveyed by the conveying roller pair 19 while the recording medium 11 is guided by the entry guides 71U and 71L, and is brought into contact with the conveying belt 62 of the conveying belt unit 81. Since the thickness of the recording medium is 0.8 mm and the gap distance L (FIG. 3) of the pre-transfer introduction portion (P, Q) is 0.7 mm, the recording medium 11 is nipped between the conveying belt 62 and the intermediate transfer belt 28 at the pre-transfer introduction portion (P, Q). Since the position of the pre-transfer introduction roller 51 (mounted to the belt frame 50) does not change, the conveying belt 62 is deformed so that the recording medium 11 is nipped between the conveying belt 62 and the intermediate transfer belt 28.

The recording medium 11 is conveyed to the secondary transfer portion 21 while being nipped between the conveying belt 62 and the intermediate transfer belt 28. At the secondary transfer portion 21, the toner image is transferred from the intermediate transfer belt 28 to the recording medium 11.

The secondary transfer roller 63 is made of urethane which is softer than the backup roller 29 made of metal, and the secondary transfer roller 63 is deformed along the surface of the backup roller 29. Since the recording medium 11 is nipped between the secondary transfer roller and the backup roller 29 at the secondary transfer portion 21, a trailing end of the recording medium 11 is biased toward the intermediate transfer belt 28 after the trailing end passes the entry guides 71U and 71L. Therefore, the trailing end of the recording medium 11 tends to be flipped up toward the intermediate transfer belt 28.

However, according to this embodiment, the recording medium 11 is nipped between the pre-transfer introduction portion (P, Q), and therefore the flipping of the trailing end of the recording medium 11 (hereinafter, referred to as "trailing end flipping") is prevented.

The recording medium 11 to which the toner image is transferred from the intermediate transfer belt 28 at the secondary transfer portion 21 is conveyed to the fixing portion 25 shown in FIG. 1.

Next, description will be made of experiments for determining preferable relationship between the thickness t of the recording medium 11 and the gap distance L of the pre-transfer introduction portion (P, Q) with reference to FIG. 3.

Printing tests were performed while varying the thickness (t) of the recording medium 11 from −0.7 mm to 3.9 mm by 0.1 mm, and varying the gap distance L of the pre-transfer introduction portion (P, Q) from 0.1 mm to 0.8 mm by 0.1 mm. In the printing tests, the speed of the intermediate transfer belt 28 was set to be the same as the speed of the conveying belt 62.

In FIG. 5, a mark "O" indicates that no image defect occurred, i.e., an excellent printing image was obtained. A mark "Δ" indicates that an image shift occurred, which was observable only by magnifying observation using an enlarging loupe or the like. A mark "X" indicates that an image shift occurred, which was observable by visual observation. A mark "◇" indicates that the transfer scattering or the trailing end flipping occurred, which was observable only by careful observation. A mark "□" indicates that the transfer scattering or the trailing end flipping occurred, which was distinctly observable.

Here, description will be made of the above described image shift, the transfer scattering and the trailing end flipping.

The image shift is an image defect caused because the toner image on the intermediate transfer belt 28 is dragged and is transferred to the recording medium 11. The reason is that a difference arises between the conveying speeds of the intermediate transfer belt 28 and the recording medium 11 while the recording medium 11 is conveyed from the pre-transfer introduction portion (P, Q) to the secondary transfer portion 21, and the toner image is transferred to the recording medium 11 at the pre-transfer introduction portion (P, Q).

Further, since no electric field is generated at the pre-transfer introduction portion (P, Q), the transfer of the toner image at the pre-transfer introduction portion (P, Q) is caused by an increasing nip force with which the recording medium 11 is nipped between the intermediate transfer belt 28 and the conveying belt 62 at the pre-transfer introduction portion.

Figure 6:
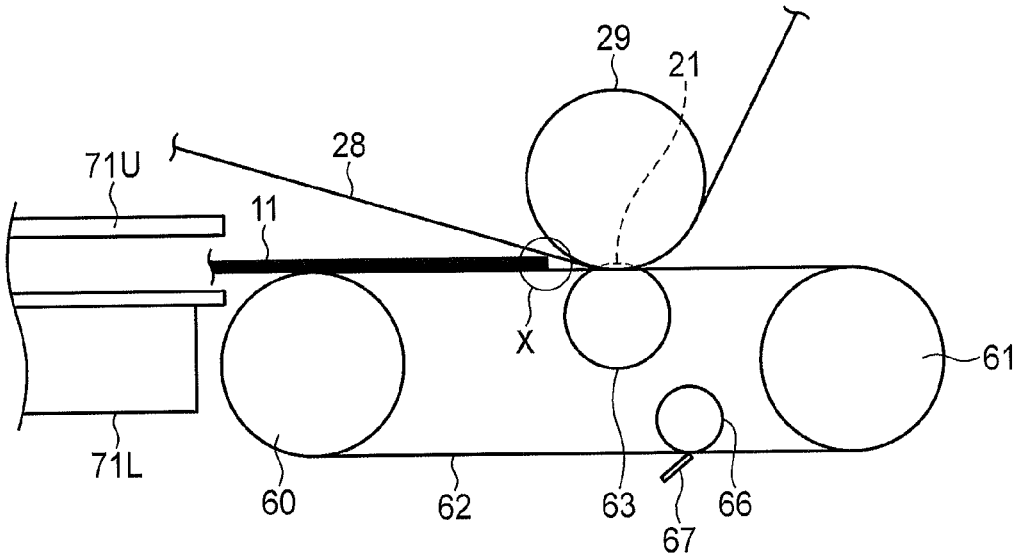
FIG. 6 shows a configuration around a secondary transfer portion of a comparison example.

FIG. 6 shows a comparison example for illustrating a state where the transfer scattering occurs. As shown in FIG. 6, when the toner image (on the intermediate transfer belt 28) and the recording medium 11 reach an electric field region X between the backup roller 29 and the secondary transfer roller 63, an electrical discharge may occur in a gap between the recording medium 11 and the intermediate transfer belt 28. The electrical discharge may cause the scattering of the toner on the intermediate transfer belt 28, and result in disturbance of toner image. Further, the scattered toner may adhere to the recording medium 11. The transfer scattering tends to occur when the leading end of the recording medium 11 reaches the vicinity of the electric field region X between the backup roller 29 and the secondary transfer roller 63. Further, if the image forming apparatus 100 is capable of using the recording media 11 of different thicknesses, the electrical discharge and resultant transfer scattering are likely to occur when using a thin recording medium 11 (i.e., a thin sheet).

Figure 7:
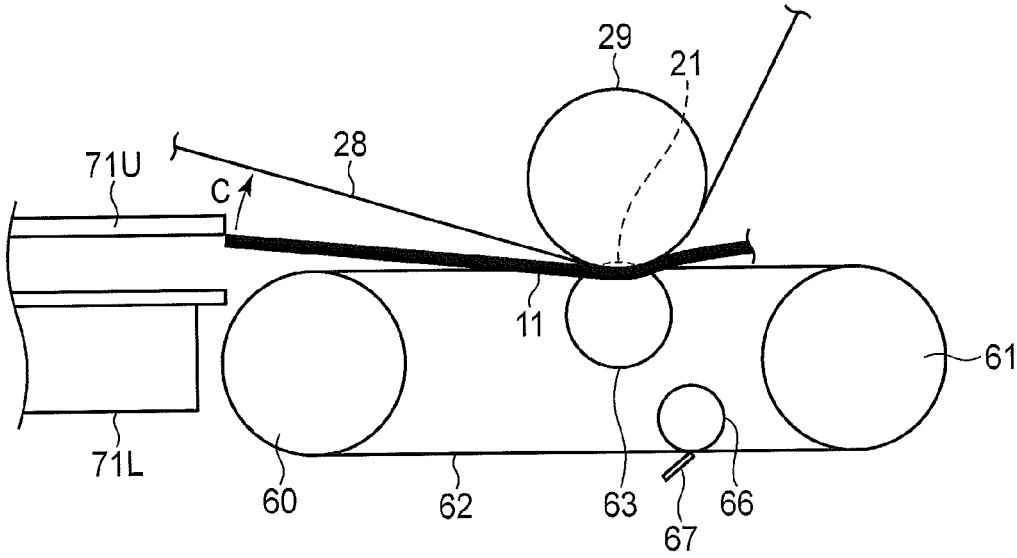
FIG. 7 shows the configuration around the secondary transfer portion of the comparison example.

FIG. 7 shows a comparison example for illustrating a state where the trailing end flipping occurs. As shown in FIG. 7, when the recording medium 11 is nipped at the nip portion between the secondary transfer roller 63 and the backup roller 29, the trailing end of the recording medium 11 is applied with a force in a direction indicated by an arrow C. Therefore, when the trailing end of the recording medium 11 passes the entry guide 71U, the trailing end of the recording medium 11 is flipped up toward the intermediate transfer belt 28. Accordingly, the trailing end of the recording medium 11 may hit the intermediate transfer belt 28, and may cause a disturbance of the toner image on the intermediate transfer belt 28, which results in image defects. This phenomenon is likely to occur when using a thick recording medium 11 (i.e., a thick sheet) having rigidity and body.

From the experimental results shown in TABLE 5, a lower limit of the gap distance L of the pre-transfer introduction portion for providing excellent image quality is obtained by subtracting 0.4 mm from the thickness (t) of the printing medium minus (i.e., t−0.4 mm). Since the lower limit of the gap distance L is determined by occurrence or non-occurrence of the image shift, a nip force at the pre-transfer introduction portion (P, Q) will be herein described.

Figure 8:
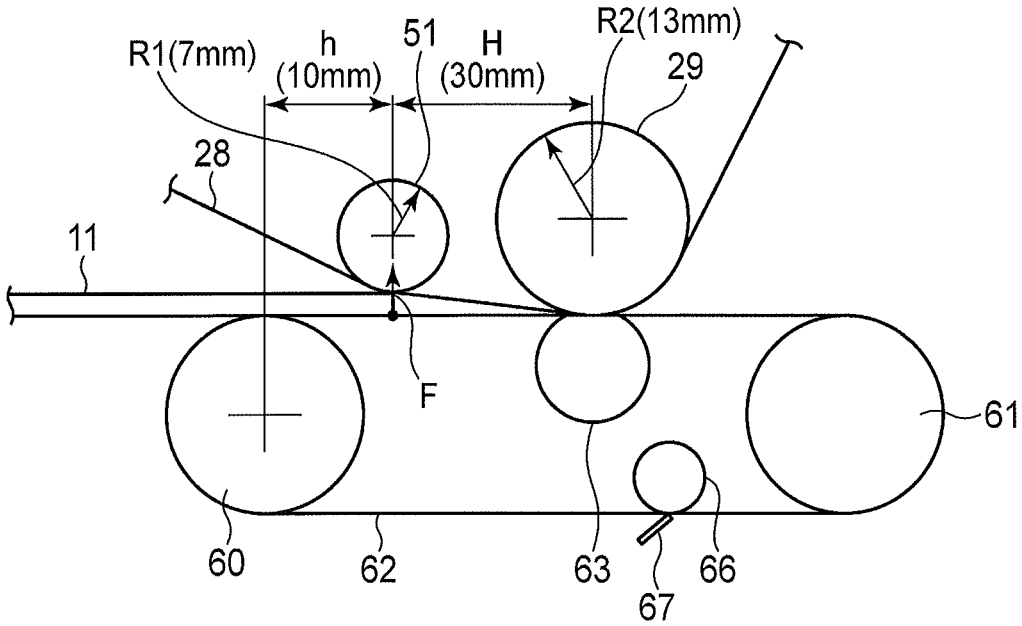
FIG. 8 is a schematic side view showing a pre-transfer introduction portion according to the first embodiment of the present invention.

FIG. 8 shows the pre-transfer introduction portion (P, Q) and the secondary transfer portion 21 of the first embodiment. In FIG. 8, a horizontal distance h between centers of the conveying belt driving roller 60 and the pre-transfer introduction roller 51 is 10 mm. A horizontal distance H between centers of the pre-transfer introduction roller 51 and the backup roller 29 is 30 mm. The gap distance L is set to 0.3 mm, and the thickness t of the recording medium 11 is set to 0.4 mm.

Since the gap distance L is 0.3 mm and the thickness of the recording medium 11 is 0.4 mm as described above, an upper part of the conveying belt 62 is pressed by 0.1 mm when the recording medium 11 is nipped at the pre-transfer introduction portion (P, Q).

In this state, a force F applied to the recording medium 11 by the conveying belt 62 is 30 N. When a tension of the conveying belt 62 is expressed as T, and a depression amount of the conveying belt 62 is expressed by D, the force F applied to the recording medium 11 by the conveying belt 62 is expressed as follows:

$$F = \frac{T \times D}{\sqrt{H^2 + D^2}} + \frac{T \times D}{\sqrt{h^2 + D^2}} \tag{1}$$

When the above described dimensions are substituted in the equation (1), the force F is determined as follows:

$$F = \frac{30(N) \times 0.1(\text{mm})}{\sqrt{30(\text{mm})^2 + 0.1(\text{mm})^2}} + \frac{30(N) \times 0.1(\text{mm})}{\sqrt{10(\text{mm})^2 + 0.1(\text{mm})^2}} \cong 0.4N$$

From the experimental results shown in FIG. 5, it is understood that the lower limit of the gap distance L of the pre-transfer introduction portion (P, Q) when the image shift does not occur is t−4 (mm), which is obtained by subtracting 4 mm from the thickness t (mm) of the recording medium 11. This means that the image shift does not occur when the depression amount D is less than or equal to 0.4 mm. When the depression amount D of 0.4 mm is substituted in the equation (1), the force F is determined as follows:

$$F = \frac{30(N) \times 0.4(\text{mm})}{\sqrt{30(\text{mm})^2 + 0.4(\text{mm})^2}} + \frac{30(N) \times 0.4(\text{mm})}{\sqrt{10(\text{mm})^2 + 0.4(\text{mm})^2}} \cong 1.6N$$

When the pre-transfer introduction roller 51 has a width (i.e., a size in the axial direction) of 300 mm, a line pressure at the pre-transfer introduction portion (P, Q) is 1.6 N÷300 mm≅0.005 N/mm. This means that the image shift does not occur when the line pressure (at a portion where the recording medium 11 enters the pre-transfer introduction portion) is approximately less than or equal to 0.005 N/mm.

From the experimental results shown in FIG. 5, it is understood that the upper limit of the gap distance L of the pre-transfer introduction portion (P, Q) when the image shift does not occur is t+2.5 (mm), which is obtained by adding 2.5 mm to the thickness t (mm) of the recording medium 11. When the gap distance L of the pre-transfer introduction portion is set to t+2.5 (mm), a gap is formed between the recording medium 11 and the intermediate transfer belt 28 at the pre-transfer introduction portion (P, Q). However, the recording medium 11 is nipped between the intermediate transfer belt 28 and the conveying belt 62 at an immediately upstream portion of the secondary transfer portion 21 in the medium conveying direction, where the recording medium 11 and the intermediate transfer belt 28 tightly contact each other. Therefore, the transfer scattering does not occur. Further, even when the trailing end of the recording medium 11 is flipped up, an amount of the flipping of the trailing end of the recording medium 11 is relatively small on condition that the gap distance L is less than or equal to t+2.5 (mm). Therefore, the flipping of the trailing end of the recording medium 11 (i.e., the trailing end flipping) does not result in image defects observable by visual observation.

As result, an excellent image printing without image defects (due to the image shift, the transfer scattering and the trailing end flipping) can be achieved when the gap distance L (mm) of the pre-transfer introduction portion (P, Q) is in the following range:

$$t_{max}\,(\text{mm}) - 0.4\,(\text{mm}) \le L\,(\text{mm}) \le t_{min}(\text{mm}) + 2.5\,(\text{mm}) \quad (2)$$

where $t_{min}$ (mm) and $t_{max}$ (mm) respectively represent a minimum thickness and a maximum thickness of the recording medium 11 used in the image forming apparatus 100.

In this embodiment, the image forming apparatus 100 is configured to use the recording medium 11 whose thickness is in a range from 0.1 mm to 0.8 mm. Therefore, the minimum thickness $t_{min}$ is 0.1 mm, and the maximum thickness $t_{max}$ is 0.8 mm. When these values are substituted in the equation (2), the following result is obtained:

$$0.4\,(\text{mm}) \le L\,(\text{mm}) \le 2.6\,(\text{mm})$$

Thus, when the gap distance L (mm) of the pre-transfer introduction portion is in a range from 0.4 mm to 2.6 mm, image defects can be prevented for the thickness of the recording medium 11 of 0.1 to 0.8 mm. In this embodiment, the gap distance L (mm) of the pre-transfer introduction portion is set to 0.7 mm, which is in the range from 0.4 mm to 2.6 mm, and therefore image defects do not occur.

Further, in this embodiment, the thickness t (mm) of the recording medium 11 and the gap distance L of the pre-transfer introduction portion (P, Q) satisfy the above described equation (2), and therefore it becomes possible to prevent image defects such as the image shift, the transfer scattering and the trailing end flipping. For example, when the image forming apparatus 100 is configured to use only the recording medium 11 whose thickness is 0.5 mm (i.e., $t_{max}$=$t_{min}$=0.5 mm), the image defects can be prevented by setting the gap distance L of the pre-transfer introduction portion (P, Q) in the following range:

$$0.1\,(\text{mm}) \le L\,(\text{mm}) \le 3.0\,(\text{mm})$$

As described above, the experimental results of FIG. 5 show that excellent images can be formed when the gap distance L of the pre-transfer introduction portion (P, Q) and the thickness t of the recording medium 11 satisfy the equation:

$$t - 0.4\,(\text{mm}) \le L\,(\text{mm}) \le t + 2.5\,(\text{mm})$$

Further, the experimental results of FIG. 5 show that experiment images can be formed when the gap distance L of the pre-transfer introduction portion (P, Q) satisfies the following equation:

$$0.4\,(\text{mm}) \le L\,(\text{mm}) \le 2.6\,(\text{mm})$$

on condition that the thickness t of the recording medium 11 is in the range from 0.1 mm to 0.8 mm.

Moreover, when a thickness of the intermediate transfer belt 28 is expressed as d (mm), it can also be said that the image defects (such as the image shift, the transfer scattering and the trailing end flipping) can be prevented when a distance P between a circumferential surface (i.e., an outer surface) of the pre-transfer introduction roller 51 and the conveying surface of the conveying belt 62 is in the following range:

$$t\,(\text{mm}) - 0.4\,(\text{mm}) + d\,(\text{mm}) \le P\,(\text{mm}) \le t\,(\text{mm}) + 2.5\,(\text{mm}) + d\,(\text{mm})$$

Figure 9:
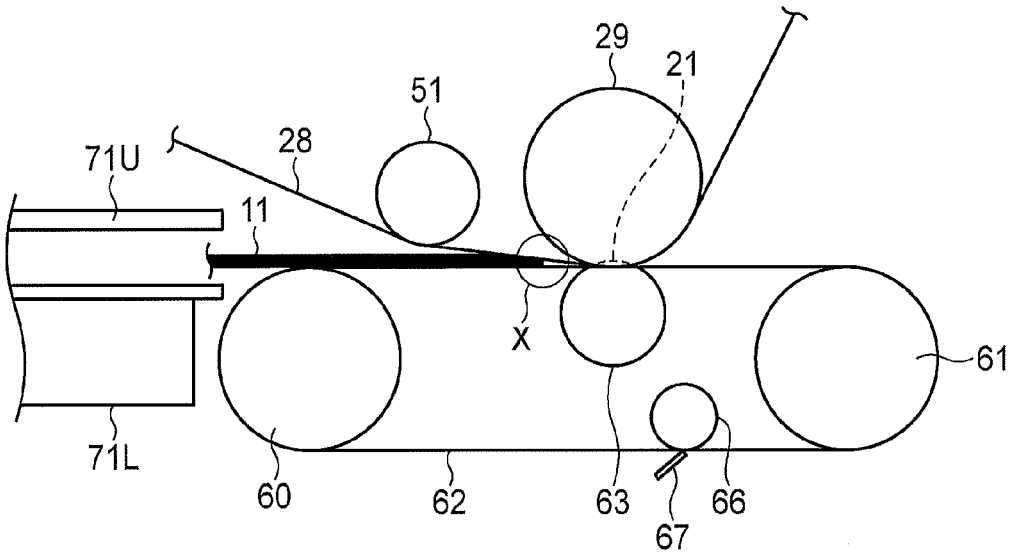
FIG. 9 shows an operation of the configuration around the secondary transfer portion according to the first embodiment of the present invention.

In this embodiment, as shown in FIG. 9, when the toner image on the intermediate transfer belt 28 and the recording medium 11 reaches the vicinity of the electric field region X between the backup roller 29 and the secondary transfer roller 63, the recording medium 11 is nipped between the intermediate transfer belt 28 and the conveying belt 62 at the upstream side (in the medium conveying direction) of the secondary transfer portion 21. Therefore, it becomes possible to prevent occurrence of transfer scattering at the electric field region X.

Figure 10:
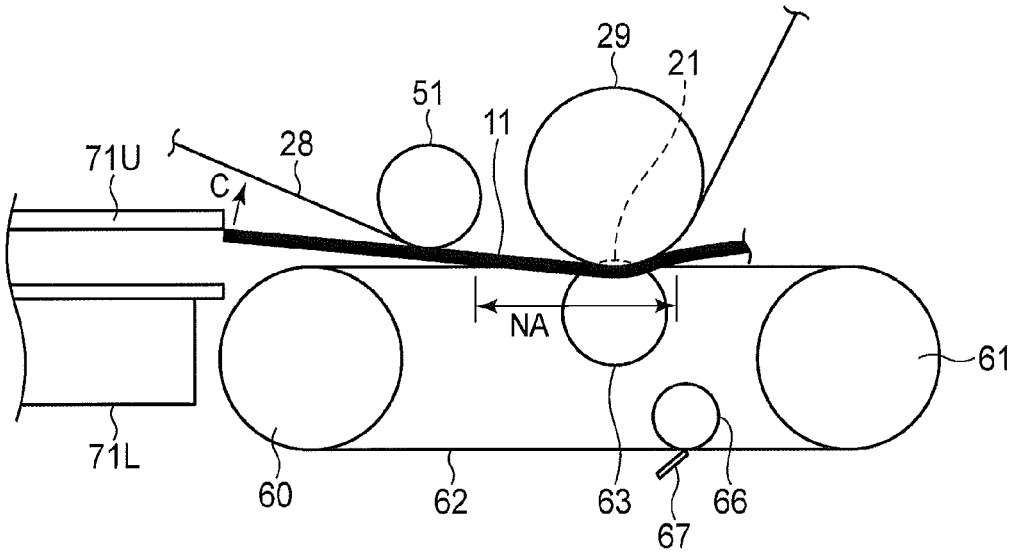
FIG. 10 shows an operation of the configuration around the secondary transfer portion according to the first embodiment of the present invention.

Further, as shown in FIG. 10, the recording medium 11 is nipped between the intermediate transfer belt 28 and the conveying belt 62 at the upstream side (in the medium conveying direction) of the backup roller 29 and the secondary transfer roller 63. Therefore, an area at which the recording medium 11 is nipped becomes larger as shown by an arrow NA in FIG. 10. Therefore, a biasing force applied to the trailing end of the recording medium 11 in the direction shown by the arrow C (that may cause the trailing end flipping) decreases.

Moreover, as shown FIG. 3, an angle θ1 between the intermediate transfer belt 28 and the conveying belt 62 at a region between the backup roller 29 and the pre-transfer introduction roller 51 is smaller than an angle θ2 between the intermediate transfer belt 28 and the conveying belt 62 at a region on the upstream side of the pre-transfer introduction roller 51 in the medium conveying direction (i.e., θ1<θ2). The entry guides 72U and 71L are located on the upstream side of the pre-transfer introduction roller 51 in the medium conveying direction. Therefore, when the trailing end of the recording medium 11 is flipped up in the direction C (FIG. 10) toward the intermediate transfer belt 28, the recording medium 11 first contacts the intermediate transfer belt 28 at the region between the pre-transfer introduction roller 51 and the backup roller 29. Thus, it becomes possible to prevent the trailing end of the recording medium 11 from hitting the intermediate transfer belt 28 to cause disturbance to the toner image on the intermediate transfer belt 28.

Further, by providing the predetermined gap distance L between the pre-transfer introduction roller 51 and the conveying belt 62 at the upstream side of the secondary transfer roller 63 and the backup roller 29 (in the medium conveying direction) as described above, it becomes possible to prevent the occurrence of the image shift resulting from the pressing of the recording medium 11 at the pre-transfer introduction portion (P, Q).

In the image forming apparatus 100 shown in FIG. 1 used for the above described experiments, the medium conveying portion 17 conveys the recording medium 11 (fed from the medium tray 10) toward the secondary transfer portion 21 while inverting the medium conveying direction. With such a configuration, when the thickness of the recording medium 11 is thinner than, for example, 0.1 mm, double feeding of the recording media may occur at the pickup roller 12. In contrast, when the thickness of the recording medium 11 is thicker than, for example, 0.8 mm, the recording medium 11 becomes less flexible, and may be jammed when the conveying direction is inverted at the medium conveying portion 17. For this reason, the above described experiments were performed while setting the thickness t of the recording medium 11 in a range from 0.1 mm to 0.8 mm (i.e., 0.1 mm≤t≤0.8 mm).

However, the thickness t of the recording medium 11 is not limited to such a range. For example, if the above described double feeding and jam are overcome by providing an MPT (Multipurpose Tray) on the upstream side of the conveying roller pair 18 in the medium conveying direction, the recording medium 11 whose thickness is not within the above described range (0.1 mm≤t≤0.8 mm) can be used.

As described above, according to the first embodiment of the present invention, the gap distance L (mm) of the pre-transfer introduction portion (P, Q) is set to be greater than or equal to $t_{max}$−0.4 (mm), and less than or equal to $t_{min}$+2.5 (mm), with the result that it becomes possible to form an excellent image without image defects (due to the image shift, the transfer scattering and the trailing end flipping).

Second Embodiment

Next, the second embodiment of the present invention will be described.

The second embodiment is different from the first embodiment in a configuration of a transfer portion.

Figure 11:
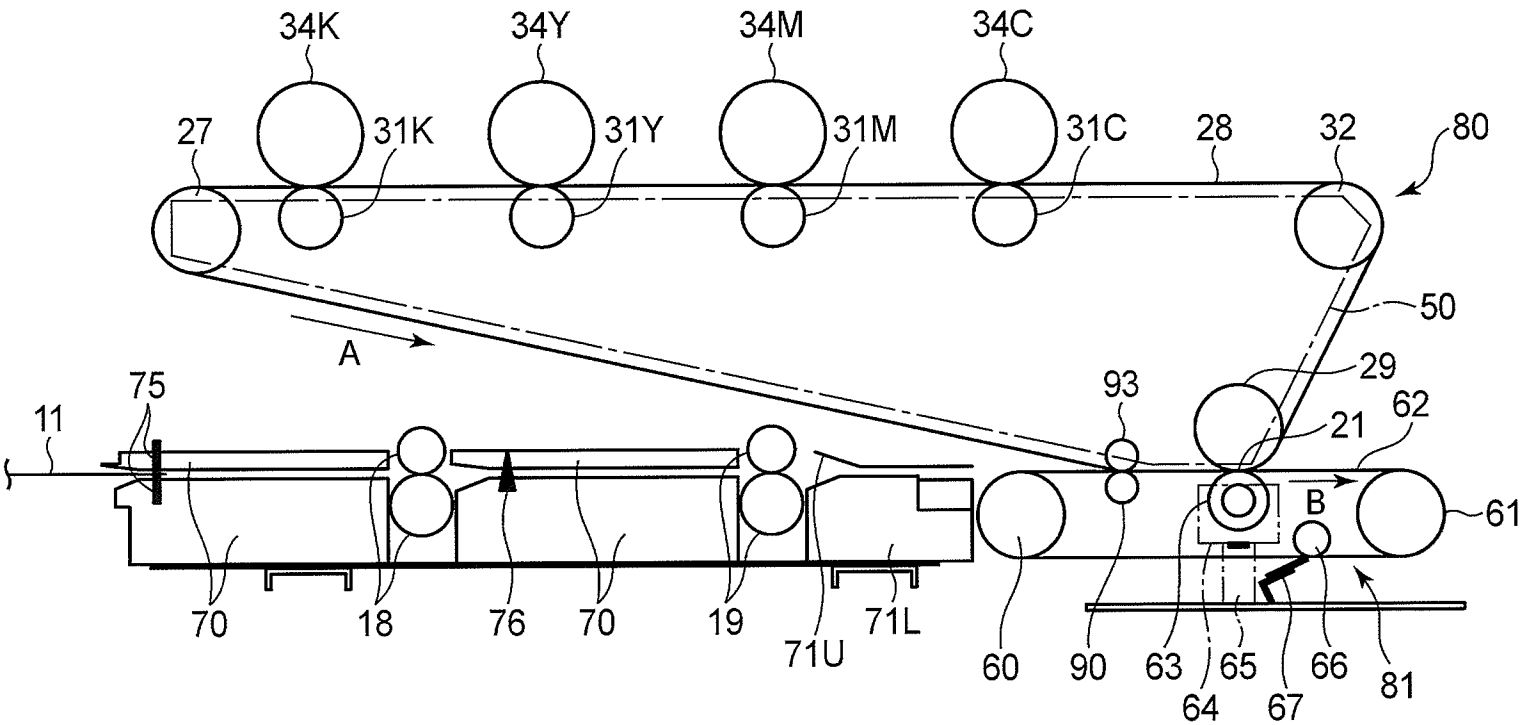
FIG. 11 is a schematic side view showing a transfer portion according to the second embodiment of the present invention.
Figure 12:
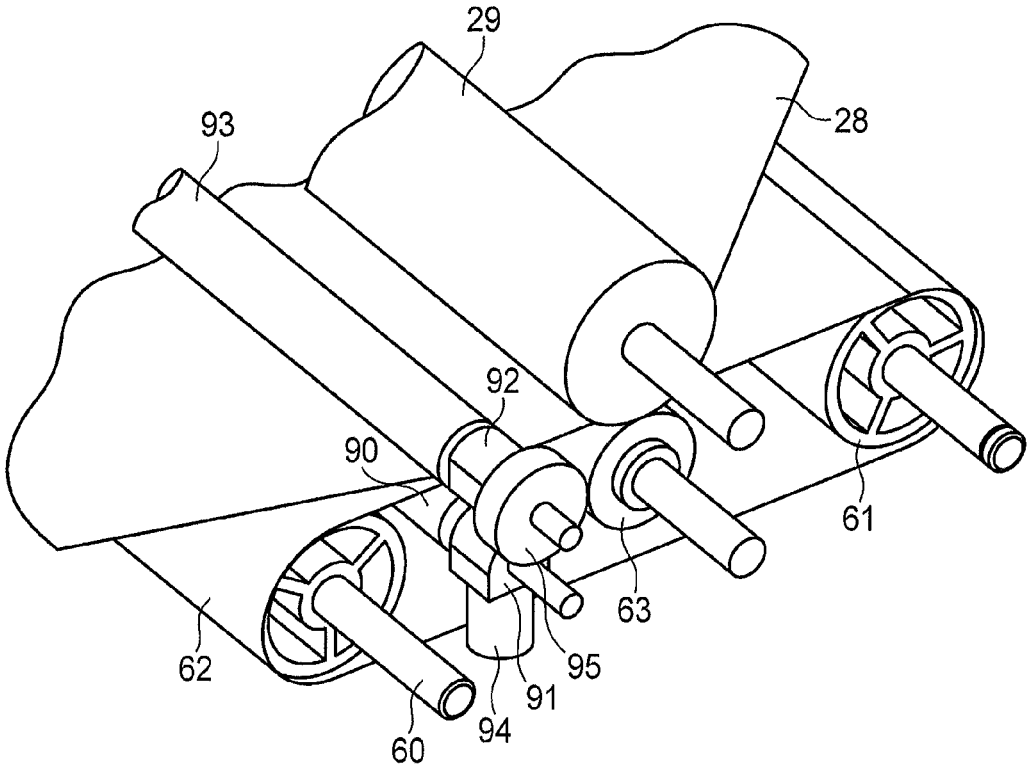
FIG. 12 is a perspective side view showing a configuration around a secondary transfer portion according to the second embodiment of the present invention.
Figure 13:
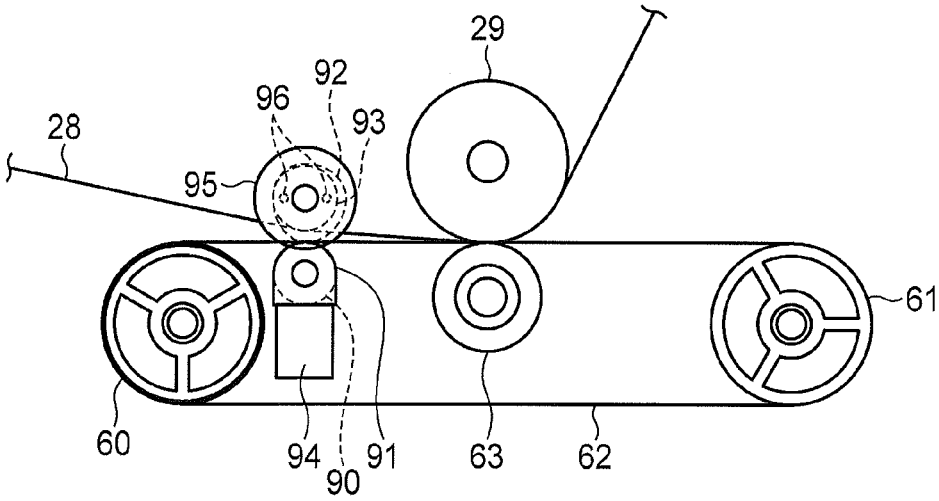
FIG. 13 is a schematic side view showing the configuration around the secondary transfer portion according to the second embodiment of the present invention.
Figure 14:
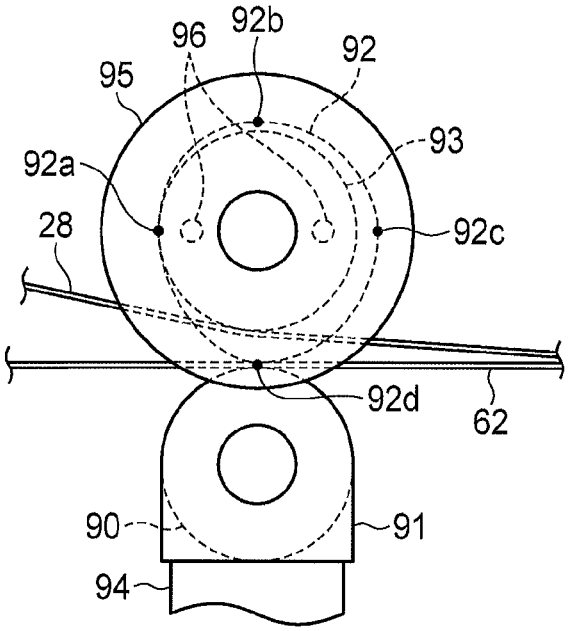
FIG. 14 is a schematic side view showing a gap adjustment portion according to the second embodiment of the present invention.

FIG. 11 is a schematic side view showing a transfer portion of an image forming apparatus according to the second embodiment. FIG. 12 is a perspective view showing a secondary transfer portion according to the second embodiment. FIG. 13 is a schematic side view showing a configuration around the secondary transfer portion 21. FIG. 14 is a schematic side view showing a gap adjusting portion according to the second embodiment. Components that are the same as those of the first embodiment are assigned the same reference numerals.

As shown in FIG. 11, a transfer portion of the second embodiment includes a transfer belt unit 80 and a conveying belt unit 81 as described in the first embodiment. Further, the transfer portion of the second embodiment includes a thickness sensor 75 as a medium thickness detecting portion provided on the upstream side of the conveyance guides 70 in the medium conveying direction. The thickness sensor 75 detects the thickness of the recording medium 11. Further, a medium sensor 76 as a medium detecting portion is provided on the downstream side of the conveying roller pair 18 in the medium conveying direction. The medium sensor 76 detects presence or absence of the recording medium 11, so as to detect the position of the recording medium 11.

The transfer belt unit 80 includes a pre-transfer introduction roller 93 (as an introduction roller) provided on the upstream side of the backup roller 29 in the conveying direction of the intermediate transfer belt 28 (shown by an arrow A in FIG. 11). A portion where the pre-transfer introduction roller 93 contacts the intermediate transfer belt 28 defines a first pre-transfer introduction portion of the second embodiment.

Here, a structure of the pre-transfer introduction roller 93 of the second embodiment will be described with reference to FIGS. 12 and 13.

In FIGS. 12 and 13, the pre-transfer introduction roller 93 is made of a metal and in the form of a shaft. A center part of the pre-transfer introduction roller 93 (around which the intermediate transfer belt 28 is stretched) has a larger diameter than both ends of the pre-transfer introduction roller 93. Gap adjustment cams are mounted to both ends of the pre-transfer introduction roller 93. The gap adjustment cams 92 are rotatable independently from the pre-transfer introduction roller 93.

Driving gears 95 are provided on outer sides of the gap adjusting cams 92. The gap adjusting cams 92 are driven in conjunction with the driving gears 95 via engaging members 96 shown in FIGS. 13 and 14.

Figure 15:
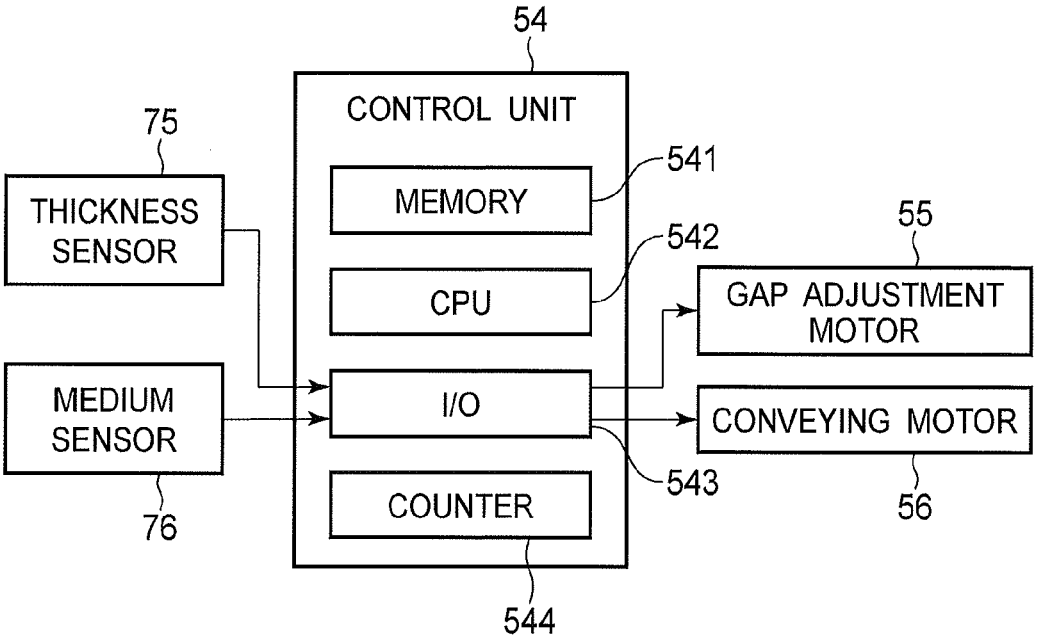
FIG. 15 is a block diagram showing a control system of an image forming apparatus according to the second embodiment of the present invention.

The driving gears 95 are linked with a gap adjustment motor 55 (FIG. 15). Rotation amounts of the driving gears 95 are controlled by the gap adjustment motor 55.

FIG. 15 is a block diagram showing a control system of the image forming apparatus 100 of the second embodiment. As shown in FIG. 15, a control unit 54 includes a memory 541 storing control programs or control information, a CPU (Central Processing Unit) 542 that performs control operation in accordance with the control program, an I/O (Input-Output) 543 as an input-output port, and a counter 544 for measuring a rotation amount of the motors. The I/O 543 is connected to the thickness censor 75 and the medium sensor 76. The I/O 543 is also connected to the gap adjustment motor 55 for rotating the above described driving gear 95 and a conveying motor 56 for rotating the conveying roller pairs 18 and 19. The gap adjustment motor 55 is a stepping motor or the like whose rotation is controllable.

The control unit 54 performs arithmetic processing based on signals from the thickness sensor 75 and the medium sensor 76 (which are input via the I/O 543) and the control information stored in the memory 541, and sends output signals to the gap adjustment motor 55 and the conveying motor 56 via the I/O 543 so as to control rotation amounts of the gap adjustment motor 55 and the conveying motor 56.

As shown in FIGS. 11 through 13, the conveying belt unit 81 is provided so as to face the backup roller 29 of the transfer belt unit 80. A gap adjustment roller 90 is provided so as to face the pre-transfer introduction roller 93 of the transfer belt unit 80.

The gap adjustment roller 90 is made of a shaft covered with a rubber layer of EPDM (Ethylene Propylene Diene Monomer). The shaft of the gap adjustment roller 90 can be composed of metal such as stainless steel (SUS), or plastic such as POM (Polyacetal). A portion where the gap adjustment roller 90 contacts the conveying belt 62 defines a second pre-transfer introduction portion of the second embodiment. The above described first pre-transfer introduction portion and the second pre-transfer introduction portion form a pre-transfer introduction portion (i.e., an introduction portion)

which corresponds to the pre-transfer introduction portion (P, Q) described in the first embodiment.

Both ends of the gap adjustment roller 90 are exposed (i.e., not covered with the rubber layer). Gap adjustment members 91 are mounted to both ends of the gap adjustment roller 90. The gap adjustment members 91 are movable toward and away from the gap adjustment cams 92 mounted to the gap adjustment roller 90 (i.e., movable in a vertical direction in FIG. 13). Further, the gap adjustment members 91 are pressed against the gap adjustment cams 92 by biasing springs 94. Positions of the gap adjustment members 91 are determined at positions where the gap adjustment members 91 contact the gap adjustment cams 92.

Next, description will be made of a gap distance L between the first pre-transfer introduction portion and the second pre-transfer introduction portion according to the second embodiment with reference to FIGS. 14 and 16.

Figure 16:
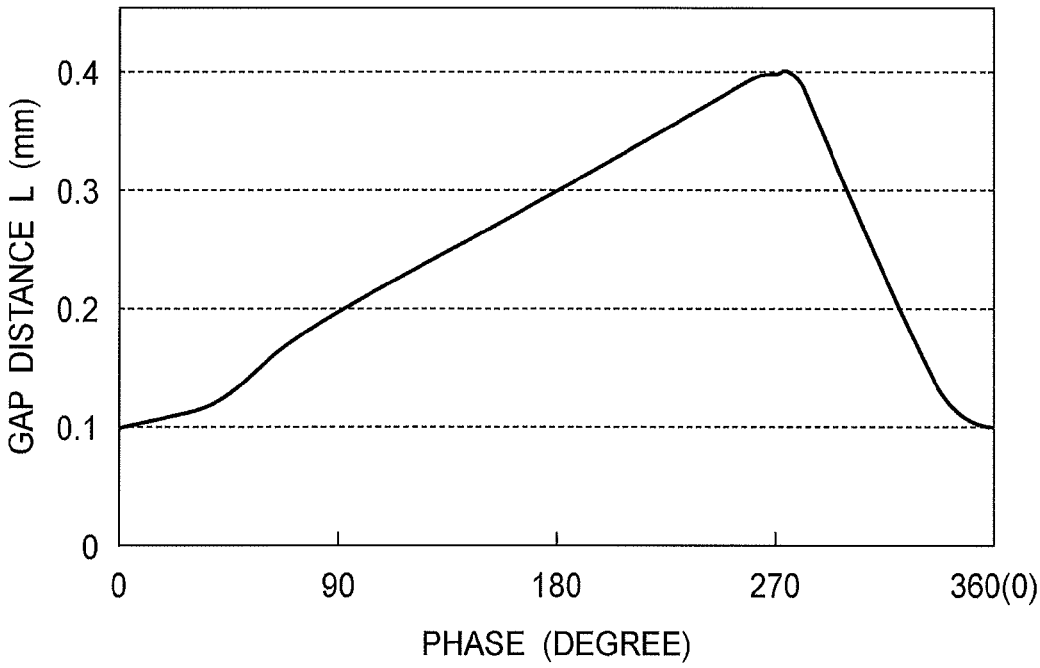
FIG. 16 is a graph showing a relationship between a phase of a gap adjusting cam and a gap distance of a pre-transfer introduction portion according to the second embodiment of the present invention.

FIG. 16 is a graph showing a relationship between a phase of the gap adjustment cam 92 and the gap distance L of the pre-transfer introduction portion. The gap distance L of the pre-transfer introduction portion varies according to the phase of the gap adjustment cam 92 as shown in FIG. 16. A curve shown in FIG. 16 is obtained by plotting the distances L of the pre-transfer introduction portion for the phases of the gap adjustment cam 92 of 0, 90, 180 and 270 degrees. In this regard, for example, four points 92*a*, 92*b*, 92*c* and 92*d* are defined on the gap adjusting cam 92 at every 90 degrees as shown in FIG. 14. When the point 92*a* contacts the gap adjustment member 91, the phase is defined to be 0. When the point 92*b* contacts the gap adjustment member 91, the phase is 90 degrees. When the point 92*c* contacts the gap adjustment member 91, the phase is 180 degrees. When the point 92*d* contacts the gap adjustment member 91, the phase is 270 degrees.

The phase of the gap adjustment cam 92 is controlled by the rotation of the gap adjustment motor 55. To be more specific, the control unit 54 (FIG. 15) applies predetermined number of pulses to the gap adjustment motor 55 so as to rotate the gap adjustment cam 92 by a predetermined rotation amount.

Figure 17:
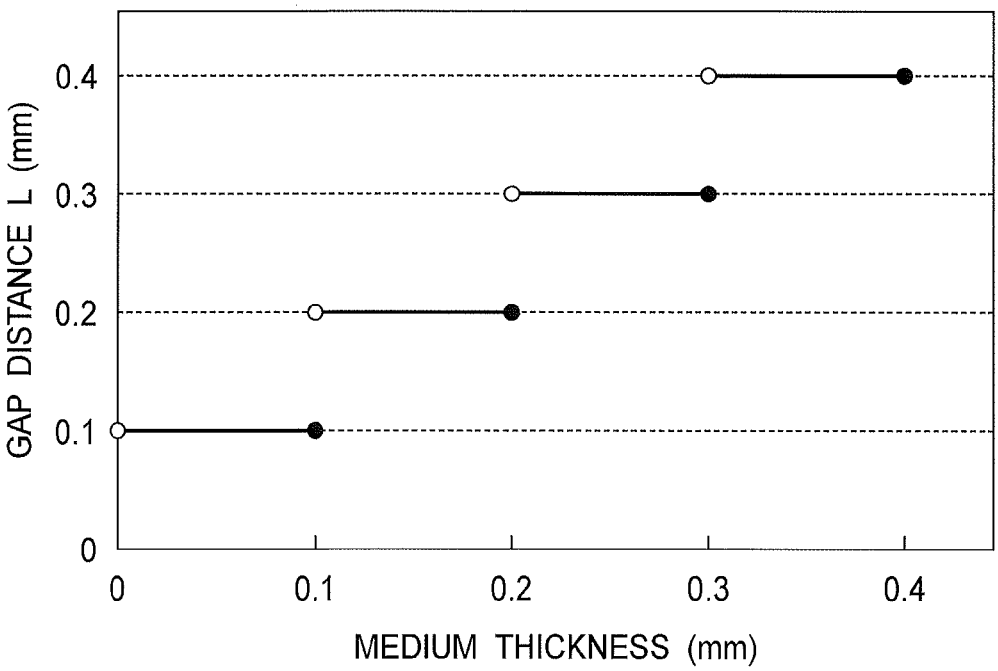
FIG. 17 is a table associating a thickness of a medium and a gap distance of the pre-transfer introduction portion according to the second embodiment of the present invention.

FIG. 17 is a table showing a relationship between the thickness (i.e., medium thickness) of the recording medium 11 and the gap distance L of the pre-transfer introduction portion according to the second embodiment. The gap distance L of the pre-transfer introduction portion is adjusted (set) in accordance with the thickness of the recording medium 11 detected by the thickness sensor 75. According to the table of FIG. 17, when the medium thickness detected by the thickness sensor 75 is thicker than 0 mm, but thinner than or equal to 0.1 mm, the gap distance L of the pre-transfer introduction portion is set to 0.1 mm. When the medium thickness detected by the thickness sensor 75 is thicker than 0.1 mm, but thinner than or equal to 0.2 mm, the gap distance L of the pre-transfer introduction portion is set to 0.2 mm. When the medium thickness detected by the thickness sensor 75 is thicker than 0.2 mm, but thinner than or equal to 0.3 mm, the gap distance L of the pre-transfer introduction portion is set to 0.3 mm. When the medium thickness detected by the thickness sensor 75 is thicker than 0.3 mm, but thinner than or equal to 0.4 mm, the gap distance L of the pre-transfer introduction portion is set to 0.4 mm. The memory 541 (FIG. 15) stores the table shown in FIG. 17 as data (i.e., adjustment data) for adjusting the gap distance L of the pre-transfer introduction portion.

Based on the thickness information inputted by the thickness sensor 75, the control unit 54 (FIG. 15) refers to the table shown in FIG. 17 and determines the gap distance L of the pre-transfer introduction portion.

An operation of the second embodiment will be described. In this regard, an entire operation of the image forming apparatus 100 of the second embodiment is the same as that of the first embodiment.

An operation of the transfer portion of the second embodiment will be described with reference to FIGS. 11, 13, 15 and 18. Here, description will be made regarding the case where continuous printing are performed on two recording media 11 with the thickness of 0.1 mm, and then printing is performed on the recording medium 11 with the thickness of 0.25 mm.

First, description will be made of the printing on the first recording medium 11 having the thickness t of 0.1 mm.

The recording medium 11 is conveyed by the medium conveying portion 17 (FIG. 1), and the thickness of the recording medium 11 is detected by the thickness sensor 75 shown in FIG. 11. The information of the thickness of the recording medium 11 is sent from the thickness sensor 75 to the control unit 54. The CPU 542 of the control unit 54 refers to the table shown in FIG. 17, and determines the gap distance L of the pre-transfer introduction portion based on the thickness information sent by the thickness sensor 75.

The memory 541 of the control unit 54 stores the data of 0.1 mm as the gap distance L of the pre-transfer introduction portion of the last printing. Here, description will be made regarding the case where the gap distance L of the pre-transfer introduction portion of the last printing is 0.3 mm with reference to a flow chart shown in FIG. 18.

Figure 18:
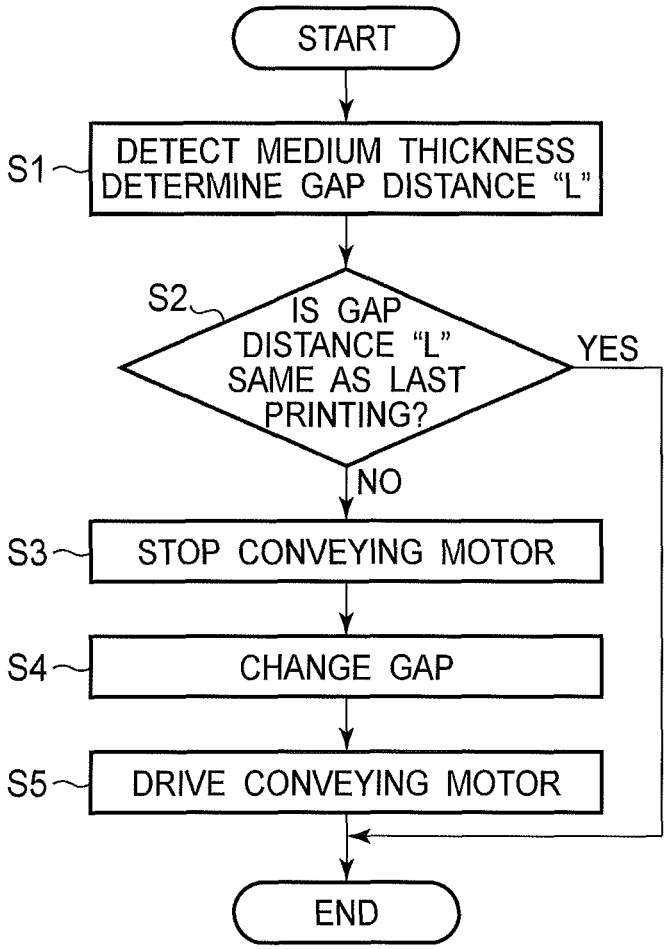
FIG. 18 is a flow chart showing a gap adjustment process according to the second embodiment of the present invention.

FIG. 18 is a flow chart showing a gap adjustment process according to the second embodiment.

In step S1, the thickness sensor 75 detects the thickness t of the recording medium 11. In this case, the thickness t of the recording medium 11 is 0.1 mm. The CPU 542 of the control unit 54 refers to the table (FIG. 17) stored in the memory 541, and determines the gap distance L of the pre-transfer introduction portion to be 0.1 mm.

In step S2, the CPU 542 of the control unit 54 compares the gap distance L determined in step S1 and the gap distance L (of the last printing) stored in the memory 541. In this case, the gap distance L (0.3 mm) determined in step S1 is different from the gap distance L (0.1 mm) stored in the memory 541 (NO in step S2), and therefore the CPU 542 proceeds to step S3.

In step S3, when the medium sensor 76 detects the leading end of the recording medium 11, the CPU 541 of the control unit 54 stops the conveying motor 56 to stop the rotation of the conveying roller pairs 18 and 19, with the result that the conveying of the recording medium 11 is stopped.

In step S4, the CPU 542 of the control unit 54 controls the rotation amount of the gap adjustment motor (linked with the driving gear 95) to rotate the gap adjustment cams 92 to a rotational position corresponds to the phase of 0 degrees so as to change the gap distance L of the pre-transfer introduction portion to 0.1 mm. When the gap adjustment cams 92 rotate, the gap adjustment members 91 are pressed upward by the force of the biasing springs 94. The movement of the gap adjustment members 91 causes the gap adjustment roller 90 to move, so that the gap distance L of the pre-transfer introduction portion is set (changed) to 0.1 mm.

In step S5, the CPU 542 of the control unit 54 (having set the gap distance L to 0.1 mm) drives the conveying motor 56 to start rotating the conveying roller pairs 18 and 19 so as to convey the recording medium 11. Printing is performed on condition that the gap distance L of the pre-transfer introduction portion (0.1 mm) is the same as the thickness t of the recording medium 11 (0.1 mm).

Next, description will be made of the printing on the second recording medium 11 having the thickness t of 0.1 mm.

The recording medium 11 is conveyed by the medium conveying portion 17 (FIG. 2), and the thickness of the recording medium 11 is detected by the thickness sensor 75 shown in FIG. 11. The information of the thickness t of the recording medium 11 (0.1 mm) is sent from the thickness sensor 75 to the control unit 54. The CPU 542 of the control unit 54 refers to the table shown in FIG. 17 according to the thickness information sent from the thickness sensor 75, and determines the gap distance L of the pre-transfer introduction portion to be 0.1 mm.

The memory 541 of the control unit 54 stores 0.1 mm as the gap distance L of the pre-transfer introduction portion of the last printing. The gap adjustment process in this case will be described with reference to FIG. 18.

In step S1, the thickness t of the recording medium 11 detected by the thickness sensor 75 is 0.1 mm. The CPU 542 of the control unit 54 refers to the table of FIG. 17 stored in the memory 541, and determines the gap distance L of the pre-transfer introduction portion to be 0.1 mm.

In step S2, the gap distance L (0.1 mm) determined in step S1 is the same as the gap distance L (0.1 mm) stored in the memory 541 (YES in step S2). Therefore, the CPU 542 of the control unit 54 does not change the gap distance, and performs printing without stopping the conveying of the recording medium 11.

Next, description will be made of the printing on the third recording medium 11 having the thickness t of 0.25 mm.

The recording medium 11 is conveyed by the medium conveying portion 17 (FIG. 2), and the thickness of the recording medium 11 is detected by the thickness sensor 75 shown in FIG. 11. The information of the thickness t of the recording medium 11 (0.25 mm) is sent from the thickness sensor 75 to the control unit 54. The CPU 542 of the control unit 54 refers to the table shown in FIG. 17 according to the thickness information sent from the thickness sensor 75, and determines the gap distance L of the pre-transfer introduction portion to be 0.3 mm.

The memory 541 of the control unit 54 stores 0.1 mm as the gap distance L of the pre-transfer introduction portion of the last printing. The gap adjustment process in this case will be described with reference to FIG. 18.

In step S1, the thickness t of the recording medium 11 detected by the thickness sensor 75 is 0.25 mm. The CPU 542 of the control unit 54 refers to the table of FIG. 17 stored in the memory 541, and determines the gap distance L of the pre-transfer introduction portion to be 0.3 mm.

In step S2, the gap distance L (0.3 mm) determined in step S1 is different from the gap distance L (0.1 mm) stored in the memory 541 (NO in step S2), and therefore the CPU 542 of the control unit 54 proceeds to step S3.

In step S3, when the medium sensor 76 detects the leading end of the recording medium 11, the CPU 541 of the control unit 54 stops the conveying motor 56 to stop the rotation of the conveying roller pairs 18 and 19, with the result that the conveying of the recording medium 11 is stopped.

In step S4, the CPU 542 of the control unit 54 controls the rotation amount of the gap adjustment motor (linked with the driving gear 95) to rotate the gap adjustment cams 92 to a rotational position corresponds to the phase of 180 degrees so as to change the gap distance L of the pre-transfer introduction portion to 0.3 mm. When the gap adjustment cams 92 rotate, the gap adjustment members 91 are pressed downward by the gap adjustment cam 92 resisting the force of the biasing springs 94. The movement of the gap adjustment members 91 causes the gap adjustment roller 90 to move, so that the gap distance L of the pre-transfer introduction portion is set (changed) to 0.3 mm.

In step S5, the CPU 542 of the control unit 54 (having set the gap distance L to 0.3 mm) drives the conveying motor 56 to start rotating the conveying roller pairs 18 and 19 so as to convey the recording medium 11, and performs printing.

In this state, since the gap distance L of the pre-transfer introduction portion is 0.3 mm, and the thickness t of the recording medium 11 is 0.25 mm, a gap is formed between the intermediate transfer belt 28 and the recording medium 11. However, a difference between the gap distance L (0.3 mm) of the pre-transfer introduction portion and the thickness t of the recording medium 11 (0.25 mm) is 0.05 mm. As described in the first embodiment, the image defects (such as the transfer scattering and the trailing end flipping) occur when the gap between the intermediate transfer belt 28 and the recording medium 11 is greater than 2.6 mm (0.1+t). Therefore, the image defects (such as the transfer scattering and the trailing end flipping) do not occur in this embodiment.

As described above, according to the second embodiment of the present invention, the gap distance L of the pre-transfer introduction portion is changed according to the thickness t of the recording medium 11. Therefore, it becomes possible to eliminate or minimize the gap between the recording medium 11 and the intermediate transfer belt 28 on the immediately upstream side of the secondary transfer portion 21. Accordingly, excellent image can be formed even when using a curled paper or the like having a tendency to occur transfer scattering.

Further, the memory 541 of the control unit 54 stores the table that associates the gap distance L of the pre-transfer introduction portion and the thickness t of the recording medium 11, and therefore the adjustment of the gap distance L of the pre-transfer introduction portion can be performed in a relatively short time period. Accordingly, the throughput can be enhanced.

In the first and second embodiments, descriptions have been made to the electrophotographic printer as an example of the image forming apparatus and the belt driving device used therein. However, the present invention is also applicable to other type of image forming apparatus such as a copier or facsimile machine configured to form an image on a recording media using electrophotography and a belt driving device used therein.

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

an image bearing body that bears a developer image;

a primary transfer body that bears the developer image, the developer image being transferred from said image bearing body to the primary transfer body;

a secondary transfer portion for transferring said developer image from said primary transfer body to a medium;

at least three rotatable bodies around which said primary transfer body is stretched, said at least three rotatable bodies including a first rotatable body disposed upstream of said secondary transfer portion in a conveying direction of said medium; and a stretched member provided so as to face said first rotatable body, wherein said primary transfer body is applied with a tension greater than a tension applied to said stretched member, wherein said primary transfer body, said stretched member, and said first rotatable body constitute an introduction portion disposed upstream of said secondary transfer portion in the conveying direction of said medium, said introduction portion introducing said primary transfer body and said medium toward the secondary transfer portion, wherein a gap is formed between said primary transfer body and said stretched member at a portion where said first rotatable body contacts said primary transfer body, and wherein said stretched member is shiftable in a shifting direction away from said primary transfer body at the portion where said first rotatable body contacts said primary transfer body, the shifting direction being not parallel to the conveying direction.

2. The image forming apparatus according to claim 1, wherein said gap is L (mm), L and a thickness t (mm) of said medium satisfy the following relationship:

$$t-0.4\ (\text{mm}) \leq L \leq t+2.5\ (\text{mm}).$$

3. The image forming apparatus according to claim 2, wherein said thickness t is in a range from 0.1 mm to 0.8 mm.

4. The image forming apparatus according to claim 1, wherein said gap is L (mm), further wherein L, a minimum thickness $t_{min}$ (mm) of a medium used in said image forming apparatus, and a maximum thickness $t_{max}$ (mm) of a medium used in said image forming apparatus all satisfy the following relationship:

$$t_{max}-0.4\ (\text{mm}) \leq L-t_{min}+2.5\ (\text{mm}).$$

5. The image forming apparatus according to claim 1, wherein said gap is L (mm) and is in the following range:

$$0.4\ (\text{mm}) \leq L \leq 2.6\ (\text{mm}).$$

6. The image forming apparatus according to claim 1, wherein said stretched member is a conveying portion that conveys said medium to said secondary transfer portion, wherein said introduction portion includes a first introduction portion provided on said primary transfer body, and a second introduction portion provided on said conveying portion.

7. The image forming apparatus according to claim 6, wherein said conveying portion is in the form of a belt.

8. The image forming apparatus according to claim 6, wherein said first introduction portion is provided on a portion where said first rotatable body contacts said primary transfer body.

9. The image forming apparatus according to claim 6, wherein said first introduction portion is provided on a portion where said first rotatable body contacts said primary transfer body, and wherein an angle θ1 between said primary transfer body and said conveying portion in a region between said first rotatable body and said secondary transfer portion is smaller than an angle θ2 between said primary transfer body and said conveying portion in an upstream region of said first rotatable body in said conveying direction of said medium.

10. The image forming apparatus according to claim 6, wherein said first introduction portion is provided on a portion where said primary transfer body is stretched around said first rotatable body, and wherein a guide member is disposed upstream of said first rotatable body in said conveying direction of said medium, said guide member guiding said medium.

11. The image forming apparatus according to claim 6, wherein said first introduction portion is provided on a portion where said primary transfer body is stretched around said first rotatable body, and wherein said first rotatable body is in the form of a roller.

12. The image forming apparatus according to claim 1, wherein said primary transfer body is in the form of a belt.

13. The image forming apparatus according to claim 1, further comprising:

a medium thickness detecting portion for detecting a thickness of said medium;

an adjustment portion for adjusting a distance of said gap; and a control unit for controlling said adjustment portion, wherein said control unit causes said adjustment portion to adjust a distance of said gap based on said thickness detected by said medium thickness detecting portion.

14. The image forming apparatus according to claim 1, further comprising a conveying belt unit that conveys said medium through said secondary transfer portion and that includes the stretched member, and the stretched member is a conveying belt.

15. The image forming apparatus according to claim 14, wherein said introduction portion is formed by said first rotatable body and said conveying belt.

16. The image forming apparatus according to claim 1, further comprising:

a pressing member provided so as to contact said primary transfer body; and a transfer member provided so as to face said pressing member via said primary transfer body and said stretched member, wherein said pressing member, said primary transfer body, said stretched member and said transfer member constitute a transfer nip region.

17. The image forming apparatus according to claim 16, wherein said pressing member has a greater hardness than that of said transfer member.

18. The image forming apparatus according to claim 1, wherein a portion of said stretched member, that is shiftable in the shifting direction away from said primary transfer body, is disposed on a straight line that is perpendicular to the stretched member and that intersects with a center of rotation of the first rotatable body.

19. An image forming apparatus comprising:

an image bearing body that bears a developer image;

a primary transfer body that bears the developer image, the developer image being transferred from said image bearing body to the primary transfer body;

a secondary transfer portion for transferring said developer image from said primary transfer body to a medium;

at least three rotatable bodies around which said primary transfer body is stretched, said at least three rotatable bodies including a first rotatable body disposed upstream of said secondary transfer portion in a conveying direction of said medium; and a stretched member provided so as to face said first rotatable body, wherein said primary transfer body has a tension greater than a tension of said stretched member, wherein said primary transfer body, said stretched member, and said first rotatable body constitute an introduction portion disposed upstream of said secondary transfer portion in the conveying direction of said medium, said introduction portion introducing said primary transfer body and said medium toward the secondary transfer portion, wherein a gap is formed between said primary transfer body and said stretched member at a portion where said first rotatable body contacts said primary transfer body, and wherein said stretched member is shiftable in a shifting direction away from said primary transfer body at the portion where said first rotatable body contacts said primary transfer body, the shifting direction being not parallel to the conveying direction.

* * * * *